US005556738A

United States Patent [19]

Takamuki et al.

[11] Patent Number: 5,556,738

[45] Date of Patent: Sep. 17, 1996

[54] SILVER HALIDE PHOTOGRAPHIC ELEMENT AND PROCESSING METHOD THEREOF

[75] Inventors: Yasuhiko Takamuki; Ken Nagami, both of Hino, Japan

[73] Assignee: Konica Corporation, Tokyo, Japan

[21] Appl. No.: 502,216

[22] Filed: Jul. 13, 1995

[30] Foreign Application Priority Data

Jul. 18, 1994 [JP] Japan ..... 6-165385
Aug. 24, 1994 [JP] Japan ..... 6-199731

[51] Int. Cl.[6] ..... G03C 1/77

[52] U.S. Cl. ..... 430/526; 430/531; 430/536; 430/537; 430/524; 430/627; 430/642; 430/603

[58] Field of Search ..... 430/531, 536, 430/537, 642, 627, 526, 567, 603, 524

[56] References Cited

U.S. PATENT DOCUMENTS

| | | | |
|---|---|---|---|
| 1,574,944 | 3/1926 | Sheppard . | |
| 1,602,592 | 10/1926 | Sheppard . | |
| 1,623,499 | 4/1927 | Sheppard et al. . | |
| 2,193,015 | 3/1940 | Weissberger | 95/88 |
| 2,278,668 | 4/1942 | Piety | 172/245 |
| 2,278,947 | 4/1942 | Reister | 95/7 |
| 2,410,689 | 11/1946 | Sheppard | 95/7 |
| 2,592,364 | 4/1952 | Weissberger et al. | 95/88 |
| 2,701,245 | 2/1955 | Lynn | 260/89.5 |
| 2,992,101 | 7/1961 | Jelley et al. | 96/23 |
| 3,297,446 | 1/1967 | Dunn | 96/107 |
| 3,297,447 | 1/1967 | McVeigh | 96/109 |
| 3,320,069 | 5/1967 | Illingsworth | 96/107 |
| 3,408,196 | 10/1968 | McVeigh | 96/108 |
| 3,408,197 | 10/1968 | McVeigh | 96/108 |
| 3,420,670 | 1/1969 | Milton | 96/109 |
| 3,442,653 | 5/1969 | Dunn | 96/108 |
| 3,489,576 | 1/1970 | Vincent et al. | 106/1 |
| 3,501,313 | 3/1970 | Willems et al. | 96/107 |
| 3,531,289 | 9/1970 | Wood | 96/108 |
| 3,591,385 | 7/1971 | Evans | 96/107 |
| 3,655,394 | 4/1972 | Illingsworth | 96/108 |
| 3,656,955 | 4/1972 | Ushimaru et al. | 96/107 |
| 3,772,031 | 11/1973 | Berry et al. | 96/108 |
| 4,047,958 | 9/1977 | Yoneyama et al. | 96/87 R |
| 4,126,459 | 11/1978 | Greenwald | 96/29 |
| 4,142,894 | 3/1979 | Hori et al. | 96/63 |
| 4,396,706 | 8/1983 | Ishii et al. | 430/403 |
| 4,414,304 | 11/1983 | Dickerson | 430/353 |
| 4,425,425 | 1/1984 | Abbott et al. | 430/502 |
| 4,439,520 | 3/1984 | Kofron et al. | 430/434 |
| 4,711,838 | 12/1987 | Grzeskowiak et al. | 430/568 |
| 5,098,818 | 3/1992 | Ito et al. | 430/536 |

FOREIGN PATENT DOCUMENTS

| | | |
|---|---|---|
| 0556845 | 8/1993 | European Pat. Off. . |
| 6-95300 | 4/1994 | Japan . |

*Primary Examiner*—Geraldine Letscher
*Attorney, Agent, or Firm*—Finnegan, Henderson, Farabow, Garrett & Dunner, L.L.P.

[57] ABSTRACT

A silver halide photographic element with enhanced sensitivity and improved pressure resistance is disclosed, comprising a support having, on at least one side thereof, hydrophilic colloidal layers including a light-sensitive silver halide emulsion layer and a nonlight-sensitive hydrophilic colloidal layer, wherein the nonlight-sensitive layer contains organic material-aggregation particles; and gelatin contained in the total hydrophilic colloidal layers provided on one side of the support amounts to a range of 1.3 to 2.5 g per $m^2$.

10 Claims, No Drawings

SILVER HALIDE PHOTOGRAPHIC ELEMENT AND PROCESSING METHOD THEREOF

FIELD OF THE INVENTION

The present invention relates to a silver halide photographic element and a processing method thereof, and particularly to a silver halide photographic element high in sensitivity and excellent in pressure characteristics even when the total processing time is 30 seconds or less at a reduced developer-replenishing rate.

BACKGROUND OF THE INVENTION

Recently, a rapid advancement in shortening of access time to an image has been made through progress in electronics, leading to further demand for more rapid processing of a silver halide element.

Technique have been known for promoting photographic-processing speed such as a developing rate, fixing rate, washing rate or drying rate by reducing the amount of gelatin used as a binder for dispersing and protecting silver halide grains to provide rapid-processability.

With reduction of the amount of gelatin used, highly sensitive silver halide grains become increasingly less able to resist external pressure, so that, when processed in an automatic processor, numerous small spot-like uneven density, so-called roller marks, produced by pressure due to unevenness of the transporting rollers operating in the developing bath of the automatic processor. Especially when processed within a total processing time of 30 seconds, the roller mark problem becomes pronounced.

Recently, furthermore, environmental pollution has been viewed as a world-wide problem, causing a rise in interest in waste-material at home and abroad to the point that responsibility for reduction in waste-material at the corporate level has been called for.

Under these conditions, reduction of photographic processing effluent becomes an urgent problem to be solved. In order to achieve such reductions, there were disclosed techniques of making tabular silver halide grains or applying selenium-sensitization to silver halide grains, as shown, for example, in JP-A 4-291252/1992 (the term "JP-A" herein means an "unexamined published Japanese patent application"). However, the level of reduction in the replenishing rate is still insufficient and it was found that further reduction lowered the level to pressure resistance.

SUMMARY OF THE INVENTION

An object of the present invention is to provide a photographic element high in sensitivity, improved in pressure resistance and suited for rapid-processing without causing the roller marks to occur even when processed at a low replenishing rate in view of environment, and a processing method thereof.

The object of the invention can be accomplished by a silver halide photographic element comprising a support having thereon a silver halide emulsion layer and a nonlight-sensitive hydrophilic colloid layer, wherein said nonlight-sensitive hydrophilic colloid layer contains organic material-aggregating particles and the total amount of gelatin contained in all hydrophilic colloid layers provided on one side of the support is 1.3 to 2.5 g per $m^2$.

DETAIL DESCRIPTION OF THE INVENTION

The organic material-aggregation particles used in the invention are each comprised of fine particles of organic material in an aggregated form. Thus, a plurality of fine particles of an organic material (primary particles) having an average size of 0.05 to 0.50 μm, aggregate with each other to form particles having an average size of 1.0 to 20.0 μm.

The aggregation particles may be either spherical or in an unfixed form. The organic material comprises a homopolymer of alkyl methacrylate, alkyl acrylate, fluorine- or silicon-substituted alkyl methacrylate, acrylate or styrene, or a copolymer thereof. As examples of monomer components, are cited methyl methacrylate, ethyl methacrylate, n-butyl methacrylate, n-hexyl methacrylate, 2-ethylhexyl methacrylate,cyclohexyl methacrylate, benzyl methacrylate, methyl methacrylate, ethyl acrylate, n-butyl acrylate, 2-hydroxyethyl methaacrylate, 2-methoxyethyl methacrylate, 2-methnesulfonamideethyl methacrylate, trifluoromethyl methacrylatel-trihydroxysilylpropyl methacrylate. Examples of polymers are as follows, in which the weight ratio of monomers is shown in the parenthese. Aggregation particles thereof are prepared so as to have an average size of 4.0 μm, comprising primary particles having an average size of 0.1 μm.

| | |
|---|---|
| B-1 | Polymethyl methacrylate |
| B-2 | Polyethyl methacrylate |
| B-3 | (Methyl methacrylate/ethyl methacrylate) copolymer (90/10) |
| B-4 | (Methyl methacrylate/ethyl methacrylate) copolymer (50/50) |
| B-5 | (Methyl methacrylate/ethyl methacrylate) copolymer (20/80) |
| B-6 | (Methyl methacrylate/stylene) copolymer (70/30) |
| B-7 | (Stylene/ehtylacrylate) copolymer (60/40) |
| B-8 | Polytrifluoromethyl methacrylate |
| B-9 | (Trifluoromethyl methacrylate/methyl methacrylate) copolymer (50/50) |
| B-10 | (Trifluoromethyl methacrylate/stylene) copolymer (30/70) |
| B-11 | Polystylene |

Among the above, polymethyl methacrylate is preferable.

As examples thereof are cited GR-5 and GR-5P (product of Sohken Chemicals Corp.). To display effects without causing deterioration in haze, an addition amount thereof is preferably 10 to 200 mg/$m^2$. It may be added to any layer such as an emulsion layer or protective layer preferably to a protective layer. Particularly, when the protective layer is divided into two or more layers, it is more preferable to add into an uppermost layer.

In the invention, the amount of gelatin contained in all of hydrophilic colloid layers including an emulsion layer provided on one side of a support is preferably 1.3 to 2.5 g/$m^2$, more preferably 1.5 to 2.3 g/$m^2$.

As gelatin is cited so-called alkali-treated gelatin or acid-treated gelatin.

As silver halide applicable in the invention, it is preferable to use tabular grains so as to achieve high sensitivity. Any silver halide such as silver bromide, silver chloride, silver chlorobromide, silver iodochlorobromide or silver iodobromide may be optionally usable. Among these, silver iodobromide is preferable.

The tabular grains are described in U.S. Pat. Nos. 4,439,520, 4,425,425 and 4,414,304 and the desired tabular grains can be readily obtained. The tabular grains are able to cause silver halide different in composition to grow epitaxially or shell on a specific site of the surface thereof. Further, to control a sensitivity speck, a dislocation line may be located on the surface or inside of the grain.

In the invention, tabular grains having an aspect ratio of not less than 2, preferably, account for 50% or more of the projected area of total grains contained in a layer containing the tabular grains.

As the proportion of the tabular grains is increased to 60%, further to 70% and furthermore to 80%, the more preferable results have been achieved. The term, an "aspect ratio" means an ratio of a diameter of a circle equivalent to the projected area of the grain to a distance between two parallel tabular faces. In the invention, the aspect ratio is not less than 2 and less than 20, preferably not less than 3 and less than 16.

Tabular grains of the invention have a thickness of not more than 0.5 μm, preferably not more than 0.3 μm. As to the size distribution of the tabular grains, is preferable a monodispersed emulsion having a coefficient of variation of grain size of 30% or less, preferably 20% or less, which is represented by a standard deviation of the grain size (S) divided by an average size (D), i.e., S/Dx100 (%). The tabular grains may be mixed with non-tabular regular crystal grains.

To control the grain growth during the course of forming the tabular grains, there may be usable a silver halide solvent such as ammonia, a thioether compound or a thione compound. During the course of physical ripening and chemical ripening, may be addenda a salt of a metal such as zinc, lead, thallium, iridium or rhodium.

In the invention, silver halide grains are preferably chemical-sensitized with a selenium-sensitizer. The selenium sensitizers used for chemical sensitization of the invention include a broad kinds of selenium compounds, as disclosed in U.S. Pat. Nos. 1,574,944, 1,602,592 and 1,623,499, and JP-A 60-150046/1985, 4-25832/1992, 4-109240/1992 and 4-147250/1992. As usable selenium sensitizers, are cited colloidal selenium, isoselenocyanates (e.g., allyl isoselenocyanate), selenoureas (e.g., N,N-dimethylselenourea and N,N,N'-triethylselenourea, N,N,N'-trimethyl-N'-heptafluoroselenourea, N,N,N'-trimethyl-N'-heptafluoropropylcarbonylselenourea and N,N,N'-trimethyl-N'-4-nitrophenylcarbonylselenourea), selenoketones (e.g., selenoacetone and selenoacetophenone), selenoamides (e.g., selenoacetoamide and N,N-dimethylselenobenzamide), selenocarboxylic acids and selenoesters (e.g., 2-selenopropionic acid and methyl-3-selenobutylate), selenophophates (e.g., tri-p-triselenophosphate) and selenides (diethylselenide, diethyldiselenide and triphenylphosphinselenide). Particularly preferable sensitizers are selenourea,selenoamide and selenoketones. Examples of using techniques of these selenium sensitizers are disclosed in the following patent specifications; U.S. Pat. Nos. 1,574,944, 1,602,592, 1,623,499, 3,297,446, 3,297,447, 3,320,069, 3,408,196, 3,408,197, 3,442,653, 3,420, 670 and 3,591,385; French Patent Nos. 2693038 and 2093209; Japanese Patent Nos 52-34491, 52-34492, 53-295 and 57-22090; JP-A 59-180536, 59-185330, 59-181337, 59-181338, 59-192241, 60-150046, 60-151637, 61-246738, 3-4221,3-24537, 3-111838, 3-116132, 3-148648, 3-237450, 4-16838, 4-25832, 4-32831, 4-96059, 4-109240, 4-140738, 4-140739, 4-147250, 4-149437, 4-184331, 4-190225, 4-191729 and 4-195035; British Patent Nos 255846 and 861984; and also in a reference of H. E. Spencer et al., Journal of Photographic Science Vol. 31, pages 158–169 (1983).

The using amount of the selenium sensitizer, depending on a selenium compound, silver halide grains and the conditions of chemical ripening, is in general $10^{-8}$ to $10^{-4}$ mol per mol of silver halide. The selenium sensitizer may be added by dissolving in an organic solvent such as water, methanol, ethanol or ethylacetate or in a mixture thereof, or premixing with an aqueous gelatin solution; or added by dispersing in the form of an emulsion of a mixed solution with organic solvent-soluble polymer as disclosed in JP-A 4-140739.

The temperature of chemical ripening by using a selenium sensitizer is preferably within a range of 40° to 90° C., more preferably 45° to 80° C. The pH and pAg are preferably 4 to 9 and 6 to 9.5, respectively.

In the chemical sensitization of the invention, the selenium sensitization may be combined with sulfur sensitization, tellurium sensitization, reduction sensitization or noble metal sensitization.

As a sulfur sensitizer, is usable those as disclosed in U.S. Pat. Nos. 1,574,944, 2,410,689, 2,278,947, 2,728,668, 3,501,313 and 3,656,955, West German Patent Application (OLS) No.1,422,869, and JP-A 56-24937 and 55-45016. Examples thereof include thiourea derivatives such as 1,3-diphenylthiourea, triethylthiourea and 1-ethyl-3-(2thiazolyl)thiourea; rhodanine derivatives; dithiacarbamic acids, organic polysulfide compounds and elemental sulfur, which is preferably rhombic α-sulfur.

The tellurium sensitization and a sensitizing method thereof are disclosed in U.S. Pat. Nos. 1,623,499, 3,320,069, 3,772,031, 3,531,289 and 3,655,394; British Patent Nos. 235,211, 1,121,496, 1,295,462 and 1,396,696; Canadian Patent No. 800,696: JP-A 204640 and 4-333043. Examples of useful tellurium sensitizer include telluroureas (e.g., N,N-dimethyltellurourea, tetramethyltellurourea, n-carboxyethyl-N,N'-dimethyltellurourea and N,N'-dimethyl-N'-phenyltellurourea), phosphine tellurides (e.g., tributylphosphine telluride, tricyclohexylphosphine telluride, triisopropylphosphine telluride, butylisopropylphosphine telluride and dibutylphenylphosphine telluride), telluroamides (e.g., telluroacetoamide and N,N-dimethyltellurobenzamide), telluroketones; telluroesters; and isotellurocyanates. Techniques of using the tellurium sensitizer are similar to those of the selenium sensitizer.

In the invention, a combined use of reduction sensitization is preferable. It is preferable to apply the reduction sensitization during the course of forming silver halide grains. The reduction sensitization is applied not only with growing silver halide grains but also at the state of interrupting the grain growth, thereafter, reduction-sensitized grains are further grown.

Gold sensitizers used in the invention include chloroauric acid, gold thiosufate, gold thiocyanate and gold complexes of thioureas, rhodanines and other compounds.

The using amount of a selenium sensitizer, sulfur sensitizer, tellurium sensitizer, reduction sensitizer and gold sensitizer is, depending on the kind of silver halide and the sensitizer, and the ripening condition, preferably within a range of $1\times10^{-4}$ to $1\times10^{-8}$ mol per mol of silver halide, more preferably $1\times10^{-5}$ to $1\times10^{-8}$ mol.

In the invention, the selenium sensitizer, sulfur sensitizer, tellurium sensitizer, reduction sensitizer or gold sensitizer may be added in the form of a solution by dissolving in water, an alcohol or another inorganic or organic solvent; or in the form of a dispersion by dispersing in a water-immiscible solvent a medium such as gelatin.

A sensitizing dye can be optionally used in the invention. Preferably, for example, are usable cyanine dyes such as exemplified compounds of S-11 through S-124 represented by formulas (I) to (III) as disclosed in JP-A 1-100533.

The sensitizing dyes may be added in combination thereof, wherein two or more dyes may be added mixedly at the same time or separately at different times. The addition amount thereof is 1 to 1000 mg per mol of silver, preferably 5 to 500 mg. Furthermore, it is preferable to add potassium iodide prior to the addition the sensitizing dye.

The sensitizing dye of the invention may be added during the period of forming silver halide grains or at any time after grain-forming and before coating. It is preferable to add the dye prior to the completion of desalting.

At the time when adding the dye, the pH of a reaction solution (conventionally, in a reaction vessel) is preferably within a range of 4 to 10, more preferably 6 to 9. The pAg of the reaction solution is preferably within a range of 5 to 11.

The sensitizing dye of the invention may be dispersed directly in an emulsion. The dye is also dissolved in an optimal solvent methanol, ethanol, methyl cellosolve, acetone, water, pyridine or a mixture thereof to be added in the form of a solution. Ultraonic may be employed for dissolution thereof. The dye may be added in the form of solid particles dispersed by use of a high-speed impeller.

An inorganic fine particles having a particle size of 1 to 300 nm of the invention is an oxide compound comprising, as main component, silicon, aluminium, titanium, indium, yttrium, tin, antimony, zinc, nickel, copper, iron, cobalt, manganese, molybdenum, niobium, zirconium, vanadium, alkali metal or alkali earth metal. Among these, from the viewpoint of transparency and hardness, is preferable silicon oxide (colloidal silica), aluminum oxide, antimony oxide, titanium oxide, zinc oxide, zirconium oxide, tin oxide, vanadium oxide or yttrium oxide. These inorganic oxide particles may be surface-treated with alumina, yttrium or cerium so as to enhance dispersion stability in water when dispersed in water to form a sol. Examples of the inorganic fine particles are cited as below.

A-1 Colloidal silica partially modified by alumina (Aq. 30 wt. % solution, av. particle size of 14 nm)

A-2 Yttrium dioxide sol (Aq. 15 wt. % solution, av. particle size of 4 nm)

A-3 Antimony pentaoxide sol (Aq. 30 wt. % solution, av. particle size of 50 nm)

A-4 Alumina sol (Aq. 30 wt. % solution, av. particle size of 14 nm)

A-5 Titanium dioxide sol (Aq. 10 wt. % solution, av. particle size of 14 nm)

A-6 Zinc oxide sol (Aq. 10 wt. % solution, av. particle size of 30 nm)

A-7 Zirconium oxide sol (Aq. 10 wt. % solution, av. particle size of 300 nm)

A-8 Tin dioxide sol (Aq. 30 wt. % solution, av. particle size of 14nm)

A-9 Vanadium pentaoxide sol (Aq. 10 wt. % solution, av. particle size of 30 nm)

A-10 Colloidal silica partially modified by cerium (Aq. 30 wt. % solution, av. particle size of 20 nm)

A-11 Alumina sol partially modified by yttrium (Aq. 10 wt. % solution, av. particle size of 30 nm)

The oxide particles preferably be shelled with gelatin previously cross-linked so as to increase miscibility with gelatin.

The inorganic fine particles shelled with gelatin are the particles covered with a gelatin shell hardened with a cross-linking agent. Each of the particles may be covered with gelatin cross-linked or a plurality of the particles are gathered with each other in a form of alloy, which may be covered with the gelatin shell. The gelatin shell may have a thickness of 1 to 500 nm. The surface of the particles may be treated with a silane-coupling agent, aluminate compound or titanium compound to modify the miscibility thereof with gelatin, as disclosed JP-A 4-257849 and 6-95300 and then the shelling may be applied.

As the cross-linking agent, are cited hardening agents conventionally used for hardening gelatin. Among them, an aldehyde, triazine compound, vinylsulfon compound and carboxy-activating type hardener are preferably used.

The gelatin used includes an alkali-processed gelatin, acid-processed gelatin and phthalated gelatin. From th viewpoint of dispersion stability, the gelatin contains preferably calsium ions in an amount of 0 to 4000 ppm.

The particles cover with a gelatin shell are prepared in the following manner. After mixing a gelatin aqueous solution and an aqueous dispersion of inorganic fine particles, to the mixture was gradually added a cross-linking agent for gelatin with stirring with a high speed stirrer having sufficient shearing force such as a homomixer or impeller at a temperature of 30° to 80° C. Dispersing was allowed to continue for 1 to 72 hours at the temperature to obtain the gelatin-shelled particles. For the purpose of prohibiting coagulation during the dispersion, to the dispersing solution was added optimally a polyphosphate salt such as sodium pyrrophosphate, sodium hexametaphosphate or sodium tripolyphosphate; polyhydric alcohol such as sorbitol, trimethylol-propane, trimethylol-ethane or trimethylo-methane; or nonionic polymer such as alkyl ester of polyethylene glycol.

Synthesis of the gelatin-shelled particles is exemplified as below.

Synthesis Example-1 (MA-1)

Alkali-processed gelatin of 260 g was dissolved in water of 8750 ml. While being maintained at 40° C., was added thereto 1000 g of colloidal silica partially modified by alumina (30 wt. % aqueous solution; average size, 14 nm). To the resulting solution with stiring at a high speed with a homomixer was added 220 ml of 3.7% formalin solution over one minute and then stirring was allowed to continue further over a period of five hours. The resulting dispersion was filtered through a filter having a pore of 3 μm in diameter to remove coagulants.

Synthesis Example-2 (MA-2)

A dispersion was prepared in the same manner as in the above described synthesis example-1, provided that to 1000 g of colloidal silica partially modified by alumina (30 wt. % aqueous solution; average size, 14 nm) to which was the same as in the example-1, was added 3.0 g of 3-glycideoxypropyl-trimethoxysilane with stirring at 50° C. for one hour was used and and stirring was done at 50° C. for 10 hours.

Synthesis Example-3 (MA-3)

A dispersion was prepared in the same manner as in the example-2, provided that the following titanium compound (TI) was used in place of silane coupling agent.

Synthesis Example-4 (MA-4)

A dispersion was prepared in the same manner as in the example-1, provided that the following compound (RH) was used as a hardener.

Synthesis Example-5 (MA-5)

A dispersion was prepared in the same manner as in the example-1, provided that acid-processed gelatin (TI) was used as a gelatin.

Synthesis Example-6 (MA-6)

A dispersion was prepared in the same manner as in the example-1, provided that as inorganic particles was used antimony pentoxide (average size, 24 nm).

Synthesis Example-7 (MA-7)

A dispersion was prepared in the same manner as in the example-2, provided that as inorganic particles was used antimony pentoxide (average size, 24 nm).

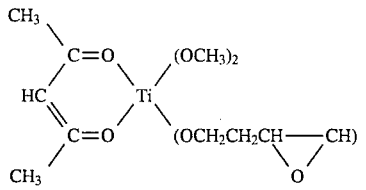

Compound (TI)

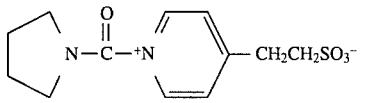

Compound (RH)

The using amount of the inorganic fine particles of the invention is 0.05 to 1.0 g in dry weight ratio to gelatin used in a layer to be added, preferably, 0.1 to 0.7. The inorganic fine particles as above-described may be in combination.

Besides the organic aggregating particles of the invention, particles of polymethyl methacrylate, copolymer of methyl methacrylate and methacrylic acid, an organic compound such as starch or an inorganic compound such as silica, titanium dioxide, strontium sulfate or barrium sulfate may be used simultaneously as a matting agent, as disclosed U.S. Pat. Nos. 2,992,101, 2,701,245, 4,142,894 and 4,396,706. The particle size thereof is 0.6 to 10 μm, preferably, 1 to 5 μm.

A silicone compound as disclosed in U.S. Pat. Nos. 3,489,576 and 4,047,958, colloidal silica as disclosed in Japanese Patent examined No. 56-23139, parafin wax, higher fatty acid esters and starch derivatives may be incorporated, as a sliding agent, in the surface layer of the inventive photographic element.

A polyol such as trimethylolpropane, pentanediol, butanediol, ethylene glycol or glycerin may be incorporated, as a plasticizer, in a component layer of the inventive photographic element.

For the purpose of improvement in pressure resistance, polymer latex may be incorporated in a component layer of the inventive photographic element. Preferable examples of polymer include homopolymer of alkylacrylate, copolymer thereof with acrylic acid or styrene, styrene-butadiene copolymer, a polymer comprising a monomer having an active methylene group, water-solubilizing group or a group capable of being cross-linked with gelatin or copolymer thereof. More preferable is a copolymer of, as main component, alkyl acrylate or styrene with a monomer having water-solubilizing group or a group capable of being cross-linked with gelatin to improve in miscibility with gelatin as a binder. Examples of a monomer having water-solubilizing group include acrylic acid, methacrylic acid, 2-acrylamide-2-methylpropane sulfonic acid and styrene sulfonic acid. Examples of a monomer having a group capable of being cross-lined with gelatin include glycidyl acrylate, glycidyl methacrylate and N-methylolacrylamide.

In the case when the inventive photographic element is employed as a both-sided X-ray photographic material for medical use, it is preferable to provide a crossover-shielding layer for the purpose of improvement in image sharpness. In the crossover-shielding layer, may be contained a dye in the form of a solid particle dispersion to absorb crossover light. Such a dye, if having such a structure as being soluble at a pH of 9 or more (alkali-soluble) and insoluble at a pH of 7 or less, is not specifically limited. From the decoloring at the time of developing, is preferable a compound of formula (I) as disclosed in JP-A 6-308670.

Preferable developing agent for developing a photographic light sensitive material of the invention include dihydroxybenzenes such as hydroquinone as disclosed in JP-A 15641 and 4-16841, paraaminophenols such as p-aminophenol, N-methyl-p-aminophenol and 2,4-diaminophenol and 3-pyrazolidones such as 1-pheny-3-pyrazolidones including 1-phenyl-3-pyrazolidone, 1-phenyl-4-methyl-4-hydroxymethyl-3-pyrazolidone and 5,5-dimethyl-l-phenyl-3-pyrazolidone. Preferably, these compounds be used in combination thereof.

The amount to be used of the above paraaminophenol or 3-aminopyrazolidone is preferably 0.004 mol/liter or more, more preferably 0.04 to 0.12 mol/liter.

The total amount of dihydroxybenzenes, paraaminophenols and 3-pyrazolidones is preferably 0.1 mol/liter or less.

As a preserving agent, may be incorporated a sulfite such as sodium sulfite or a reductone such as piperidinohexose reductone. The addition amount thereof is preferably 0.2 to 1 mol/liter, more preferably, 0.3 to 0.6 mol/liter. It is preferable to add a large amount of ascorbic acid so as to improve processing stability.

As a pH-adjusting agent, may be incorporated an alkali agent such as sodium hydroxide, potassium hydroxide, sodium carbonate, potassium carbonate, sodium phosphate or sodium phosphate.

As a pH-buffering agent, may be used borate as described in JP-A 61-28708, saccharose as described in JP-A 60-93439, acetooxime, 5-sulfosalicylic acid, phosphate and carbonate. These compounds are contained in such an amount as to maintain a pH of a developer within a rangre of 9.0 to 13, preferably, 10 to 12.5.

There may be incorporated a dissolving aid such as polyethylene glycols and an ester thereof, a sensitizer such as quaternary ammonium salt, a development-accelerating agent and a surface active agent.

As an antisilver-slugging agent, may be incorporated an antisilver-stain agent as disclosed in JP-A 56-106244, sulfide and disulfide as disclosed in JP-A 3-51844, cystein derivatives as disclosed in JP-A 5-289255 and a triazine compound.

As an organic restrainer, are usable an azole type antifoggants including indazoles, imidazoles, benzimidazoles, triazoles, benztriazoles tetrazoles and thiazoles. As an inorganic restrainer, are included sodium bromide, potassium bromide and potassium iodide. In addition, are usable compounds as described in L. F. A. Mason, "Photographic processing Chemistry", Focal Press (1966), pages 226–229, U.S. Pat. Nos. 2,193,015 and2,592,364 and JP-A 48-64933.

As a chelating agent used for masking a calcium ion contaminated in tab-water used in a processing solution, is cited an organic chelating agent having a chelating stability constant with iron of 8 or more, as disclosed in JP-A 1-193853. As an inorganic chelating agent are cited sodium hexametaphosphate, calcium hexametaphosphate and a polyphosphate salt.

As a developer hardener, are usable dialdehyde compounds. Among these compounds, is preferably used glutar aldehyde.

In the invention, replenishment, which corresponds to processing exhaustion and oxidative exhaustion is conducted at a rate of 35 to 98 ml per $m^2$ of photographic element. A replenishing method may be the replenishment depending on the width of a photographic material and transporting speed thereof as disclosed in JP-A 55-126243; area-monitoring replenishment as disclosed in JP-A 60-104946 and area-monitoring replenishment controlled by the number of running-processed films as disclosed in JP-A 1-149256.

A preferable fixer may contain fixing materials conventionally used in the art. The pH of a fixer is 3.8 or more, preferably 4.2 to 5.5. Examples of fixing agents include thiosulfates such as ammonium thiosulfate and sodium thiosulfate and ammonium thiosulfate is preferable from the viewpoint of the fixing speed. A concentration of ammonium thiosulfate is preferably 0.1 to 5 mol/liter, more preferably 0.8 to 3 mol/liter.

In the invention, there may be used an acid hardening fixer, in which an aluminium ion is preferably used as a hardener. For example, it is preferable to add in the of aluminium sulfate, aluminium chloride and potassium alum.

In addition, the fixer may optionally contain a preserver such as a sulfite or bisulfite; pH-buffering agent such as acetic acid or boric acid; pH-adjusting agent including various acids such as mineral acid (sulfuric acid and nitric acid), organic acid (citric acid, oxalic acid and maleic acid) and chloric acid, and metal hydroxide (potassium hydroxide and sodium hydroxide); and chelating agent having capability of softening hard water.

As a fixing-accelerator is cited a thiourea derivative as disclosed in Japanese Patent examined 45-35754, 58-122535 and 58-122536 or a thioether as disclosed in U.S. Pat. No. 4,126,459.

It is preferable that a silver halide emulsion layer of the invention has a swelling-in-water ratio at processing of 150 to 250% and a swelled layer thickness is 70 μm or less. When the swelling ratio exceeds 250%, drying defects occur, causing a tracking problem in automatic processor processing, particularly when rapid-processed. When the swelling ratio is less than 150%, developing unevenness and residual color are liable to be caused. The term, "swelling-in-water ratio" is defined as being a difference of layer thickness between after and before swelling, divided by a layer thickness before selling and multiplied by 100.

The photographic element of the invention displays excellent performance in rapid processing within a total processing time of 10 to 30 seconds with an automatic processor. In the rapid processing of the invention, the temperature and time of processing steps such as developing and fixing are respectively 25° to 50° C. and 15 sec. or less for each step, and preferably 30° to 40° C. and 2 to 10 sec. In the invention, the photographic material is developed and fixed, followed by washing. In the invention, washing by counter current flow with 2 or 3 stages is conducted to save water. When washing with a small amount of water, it is preferable to install a washing bath provided with a squeegee roller. The washing temperature and time are preferably 5° to 50° C. and 2 to 10 sec., respectively.

The photographic material of the invention is developed, fixed, washed and then dried via a squeegee roller. The photographic material is dried by the way of heat-air convection drying, radiation drying with a far-infrared heater or heat-transfer drying with a heat-roller. The drying temperature and time are 40° to 100° C. and 4 to 15 sec., respectively. The total processing time in the invention refers to the time through which the photographic material is inserted to the inlet of a processor, and thereafter it passes through a developing bath, a cross-over section, a fixing bath, a cross-over section, washing bath, a cross-over section and a drying zone until the top of the photographic material reaches drying section outlet. In the silver halide photographic material of the invention, it is possible to reduce the amount of gelatin used as a binder in an emulsion layer and protective layer without deteriorating pressure resistance so that rapid processing can be completed within a total processing time of 10 to 30 sec.

EXAMPLES

Preferable embodiments of the present invention will be explained as below.

Example 1

Preparation of a seed grain emulsion

| | | |
|---|---|---|
| A1 | Ossein gelatin | 24.2 g |
| | Water | 9657 ml |
| | Sodium polypropyleneoxy-polyethlene-oxydisuccinate (10% ethanol solution) | 6.78 ml |
| | Potasium bromide | 10.8 g |
| | 10% nitric acid | 114 ml |
| B1 | 2.5N Silver nitrate aqueous solution | 2825 ml |
| C1 | Potassium bromide | 824 g |
| | Potassium iodide | 23.5 g |
| | Water to make | 2825 ml |
| D1 | 1.75N Potassium bromide aqueous solution | |
| | An amount necessary for control silver potential | |

To Solution A1 at 35° C. with stirring by a mixer as described in Japanese Patent examined Nos. 58-58288 and 58-58289, were added 464.3 ml each of Solutions B1 and C1 by a double jet method over a period of 1.5 min. to form nucleus grains. After interrupting the addition of Solutions B1 and C1, the temperature of Solution A1 was raised to 60° C. by taking 60 min. and the pH thereof was adjusted to 5.0 with 3% KOH solution. Thereafter, Solutions of B1 and C1 were added by a double jet method at a rate of 55.4 ml/min. over a period of 42 min. Silver potentials over the period of time of raising a temperature from 35° to 60° C. and of the double jet-addition of Solutions of B1 and C1 were controlled so as to be maintained at 8 and 16 mv, respectively, using Solution D1. The silver potential was measured using a silver ion-selecting electrode with a saturated silver-silver chloride electrode as a reference electrode.

After completing addition, the pH thereof was adjusted to 6 with 3% KOH solution and the emulsion was subjected to desalting-washing. It was proved by electron microscopic observation that the resulting seed grain emulsion was comprised hexagonal tabular grains having a maximum adjacent edge ratio of 1.0 to 2.0 and accounting for 90% or more of the projected area of total silver halide grains contained in the emulsion, the hexagonal tabular grains having an average thickness of 0.06 μm and an average diameter (circle equivalent diameter) of 0.59 μm. Coefficients of variation of the thickness and distance between twin planes were 40 and 42%, respectively.

Preparation of Emulsion Em-1

Using the above-described seed emulsion and the following four kinds of solutions, there was prepared an emulsion containing tabular grains having a core/shell structure.

| | | |
|---|---|---|
| A2 | Ossein gelatin | 11.7 g |
| | Sodium polypropyleneoxy-polyethylene-oxydisuccinate (10% ethanol solution) | 1.4 ml |
| | Seed emulsion | 0.1 mol equivalent |
| | Water to make | 550 ml |
| B2 | Ossein gelatin | 5.9 g |
| | Potassium bromide | 6.2 g |
| | Potassium iodide | 0.8 g |
| | Water to make | 145 ml |
| C2 | Silver nitrate | 10.1 g |
| | Water to make | 145 ml |
| D2 | Ossein gelatin | 6.1 g |
| | Potassium bromide | 94 g |
| | Water to make | 304 ml |
| E2 | Silver nitrate | 137 g |
| | Water to make | 304 ml |

To Solution A2 at 67° C. with vigorously stirring, were added Solutions of B2 and C2 by a double jet method over a period of 58 min. and then, Solutions of D2 and E2 were added by a double jet method over a period of 48 min., while maintained at a pH and pAg of 5.8 and 8.7, respectively.

After completing addition, the emulsion was subjected to desalinization-washing. The resulting emulsion had respectively a pAg and pH of 8.5 and 5.85 at 40° C., containing 0.5 mol % iodide on the average.

It was proved by electron microscopic observation that 81% or more of the total projected area of silver halide grains accounted for by tabular grains having an average grain size of 0.96 μm, a grain size distribution width of 19% and an average aspect ratio of 4.5. The average of distances between twin planes (a) was 0.019 μm and coefficient of variation of (a) was 28%.

Preparation of Seed Grain Emulsion-2 Seed Emulsion -2 Was Prepared in the Following Manner.

| | | |
|---|---|---|
| A4 | Ossein gelatin | 100 g |
| | Potassium bromide | 2.05 g |
| | Water to make | 11.5 l |
| B4 | Ossein gelatin | 55 g |
| | Potassium bromide | 65 g |
| | Potassium iodide | 1.8 g |
| | 0.2N Sulfuric acid | 38.5 ml |
| | Water to make | 2.6 l |
| C4 | Ossein gelatin | 75 g |
| | Potassium bromide | 950 g |
| | Potassium iodide | 27 g |
| | Water to make | 3.0 l |
| D3 | Silver nitrate | 95 g |
| | Water to make | 2.7 l |
| E2 | Silver nitrate | 1410 g |
| | Water to make | 3.2 l |

To a reaction vessel containing Solution A4 maintained at 60° C., were added Solutions B4 and C4 by a controlled double jet method over a period of 30 min. and then Solutions C4 and E2 were added by a controlled double jet method over a period of 105 min. The addition was carried out at a stirring of 500 rpm and at a flow rate that produced no new clear and did not cause Ostwald ripening to widen a grain-size distribution. The pAg at the time of adding silver ion and halide ion solution was adjusted to 8.3±0.05 by use of a potassium bromide solution and the pH was adjusted to 2.0±0.1 by sulfuric acid.

After completing addition, the emulsion was adjusted to a pH of 6.0 and subjected to washing to remove excessive salts according to the procedure as described in Japanese Patent examined 35-16086.

It was revealed by electron microscopic observation that the resulting seed emulsion was comprised of cube-shaped and slightly chipped tetradecahedral grains having an average grain size of 0.27 μm and a grain size distribution width (coefficient of variation of grain size) of 17%.

Preparation of Emulsion Em-2

Using the above-described seed emulsion and the following seven kinds of solutions, was prepared a monodispersed core/shell type grain emulsion.

| | | |
|---|---|---|
| A5 | Ossein gelatin | 10 g |
| | Aqueous ammonia solution | 28 ml |
| | Glacial acetic acid | 3 ml |
| | Seed emulsion-2 | 0.119 mol equivalent |
| | Water to make | 600 ml |
| B5 | Ossein gelatin | 0.8 g |
| | Potassiun bromide | 5 g |
| | potassium iodide | 3 g |
| | Water to make | 110 ml |
| C5 | Ossein gelatin | 2.0 g |
| | Potassium bromide | 90 g |
| | Water to make | 240 ml |
| D4 | Silver nitrate | 9.9 g |
| | Aqueous ammonia solution (28%) | 7.0 ml |
| | Water to make | 110 ml |
| E3 | Silver nitrate | 130 g |
| | Aqueous ammonia solution (28%) | 100 ml |
| | Water to make | 240 ml |
| F1 | Potassium bromide | 94 g |
| | Water to make | 165 ml |
| G1 | Silver nitrate | 9.9 g |
| | Aqueous ammonia solution (28%) | 7.0 ml |
| | Water to make | 110 ml |

Solution A5 was maintained at 40° C. with stirring at 800 rpm with a stirrer. The solution was adjusted to a pH of 9.90 by acetic acid and was added thereto Seed emulsion-2 to form a suspension, and then Solution G1 was added at a constant rate over a period of 7 min. to make a pAg of 7.3. Further, Solutions B5 and D4 were simultaneously added over a period of 20 min. The pH and pAg thereof were adjusted to 8.83 and 9.0 over a period of 10 min. with potassium bromide aqueous solution and acetic acid; then, Solutions C5 and E3 were further added simultaneously over a period of 30 min.

The ratio of a flow rate at start to that at finish was 1:10 and the flow rate was increased with time. The pH was lowered from 8.83 to 8.00 in proportion to the flow rate ratio. When two thirds of Solutions C5 and E3 was added, Solution F1 was further added at a constant rate over a period of 8 min., wherein the pAg was increased from 9.0 to 11.0 and the pH was adjusted to 6.0.

Next, in a similar manner to emulsion Em-1, a monodispersed core/shell type grain emulsion was prepared, comprising slightly-rounded tetradecahedral grains having an average size of 0.40 μm, an average iodide content of 2 mol %, grain size distribution width of 14% and an average aspect ratio of 1.2.

Thus prepared emulsions (Em-1 and Em-2) were heated to 60° C. and thereto was added a given amount of spectral sensitizing dyes as below, in the form of a solid particle dispersion. Thereafter, was further added a mixture solution of adenine, ammonium thiocyanate, chloroauric acid and sodium thiosulfate and triphenylphophin selenide in the form of a solid particle dispersion. After 60 min., silver iodide fine grains were added and ripening was conducted over a period of 2 hr. in total.

When having completed the ripening, was added a given amount of 4-hydroxy-6-methyl-l,3,3*a*, 7-tetrazaindene (TAI) as a stabilizer.

| | |
|---|---|
| Spectral sensitizing dye (A) | 120 mg |
| Spectral sensitizing dye (B) | 2.0 mg |
| Adenine | 15 mg |
| Potassium thiocyanate | 95 mg |
| Chloroauric acid | 2.5 mg |
| Sodium thiosulfate, amount as shown in table 1 | |
| Triphenylphosphine selenide, amount as shown in Table 1 | |
| Silver iodide fine grains | 280 mg |
| TAI | 50 mg |

Solid particle dispersions of spectral sensitizing dyes and triphenylphosphine selenide were each prepared according to the method as disclosed in JP-A 5-297496. Thus, a given amount of the dyes was added water at 27° C., followed by stirring at 500 rpm with a high-speed stirrer (Disolver) over a period of 30 to 120 min.

Spectral Sensitizing dye (A):

5,5'-dichloro-9-ethyl-3,3'-di-(sulfopropyl)-oxacarbocyanine sodium salt anhydride Spectral Sensitizing Dye (B):

5,5'-di-(butoxycarbonyl)-1,1'-diethyl-3,3'-di-(4-sulfobuthyl) benzoimidazolocarbocyanine sodium salt anhydride Photographic material samples were prepared by simultaneously multilayer-coating the following coating solutions on both side of subbed blue-colored polyethylene terephthalate support having a thickness of 175 μm in the order of a crossover light-cutting layer, emulsion layer and protective layer.

Preparation of Sample

| 1st layer (crossover light cutting layer) | |
|---|---|
| Dye (AH) in the form of a solid particle dispersion | 50 mg/m$^2$ |
| Gelatin | 0.2 g/m$^2$ |
| Sodium dodecylbenzenesulfonate | 5 mg/m$^2$ |
| Compound (I) | 5 mg/m$^2$ |
| Sodium 2,4-dichloro-6-hydroxy-1,3,5-triazine | 5 mg/m$^2$ |
| Colloidal silica (average size: 0.014 μm) | 10 mg/m$^2$ |
| Latex (L) | 0.2 g/m$^2$ |
| Potassium polystylenesulfonate | 50 mg/m$^2$ |

2nd layer (emulsion layer)

To each of emulsions above-described were added the following additives.

| | |
|---|---|
| potassium tetrachloroparadium (II) | 100 mg/m$^2$ |
| Compound (G) | 0.5 mg/m$^2$ |
| 2,6-Bis(hydroxyamino)-4-diethylamino-1,3,5-triazine | 5 mg/m$^2$ |
| t-Buthylcatecol | 130 mg/m$^2$ |
| Polyvinylpyrrolidone (M.W.: 10,000) | 35 mg/m$^2$ |
| Styrene-maleic acid copolymer | 80 mg/m$^2$ |
| Polystyrenesulfonic acid, sodium salt (M.W.: 600,000) | 80 mg/m$^2$ |
| Trimethylolpropane | 350 mg/m$^2$ |
| Diethylene glycol | 50 mg/m$^2$ |
| Nitrophenyl-triphenylphosphonium chloride | 20 mg/m$^2$ |
| Ammonium 1,3-dihydroxybenzene-4-sulfonate | 500 mg/m$^2$ |
| Sodium 2-mercaptobenzimidazole-5-sulfonate | 5 mg/m$^2$ |
| Compound (H) | 0.5 mg/m$^2$ |
| n-$C_4H_9OCH_2CH(OH)CH_2N(CH_2COOH)_2$ | 350 mg/m$^2$ |
| Compound (M) | 5 mg/m$^2$ |
| Compound (N) | 5 mg/m$^2$ |
| Inventive inorganic fine grains (Table 1) | 0.5 g/m$^2$ |
| Latex (L) | 0.4 mg/m$^2$ |
| Dextrin (M.W.: 1000) | 0.2 g/m$^2$ |
| Sorbitol | 0.1 g/m$^2$ |

The amount of gelatin was adjusted, as shown in Table 1.

| 3rd layer (lower protective layer) | |
|---|---|
| Gelatin | 0.2 g/m$^2$ |
| Latex (L) | 0.2 mg/m$^2$ |
| Polyacrylic acid, sodium salt (M.W.: 50,000) | 30 mg/m$^2$ |
| Compound (K) | 15 mg/m$^2$ |
| 4th layer (upper protective layer) | |
| Gelatin | 0.4 g/m$^2$ |
| TAI | 50 mg/m$^2$ |
| Inventive aggregate particles (Table 1) | 50 mg/m$^2$ |
| Colloidal silica (Av. size: 0.014 μm) | 10 mg/m$^2$ |

-continued

| | |
|---|---|
| Formaldehyde | 20 mg/m$^2$ |
| Sodium 2,4-dichloro-6-hydroxy-1,3,5-triazine | 10 mg/m$^2$ |
| Bis-vinylsulfonylmethylether | 36 mg/m$^2$ |
| Polyacrylamide (M.W.: 10,000) | 0.1 g/m$^2$ |
| Polysiloxane (SI) | 20 mg/m$^2$ |
| Compound (I) | 12 mg/m$^2$ |
| Compound (J) | 2 mg/m$^2$ |
| Compound (S-1) | 7 mg/m$^2$ |
| Compound (O) | 50 mg/m$^2$ |
| Compound (S-2) | 5 mg/m$^2$ |
| Compound (F-1) | 3 mg/m$^2$ |
| Compound (F-2) | 2 mg/m$^2$ |
| Compound (F-3) | 1 mg/m$^2$ |
| Compound (P) | 100 mg/m$^2$ |

The coating amount of the additives as shown above is the amount per one side of the support, and coating weight of silver is adjusted so as to be 1.0 g per one side of the support.

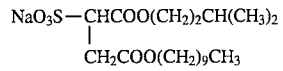
Compound (S-1)

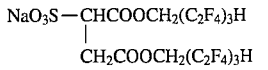
Compound (S-2)

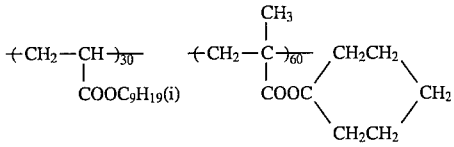
Latex (L)

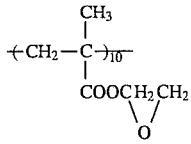

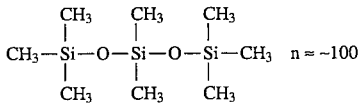
Polysiloxane (S1)

Dye (AH) in the form of a solid particle dispersion

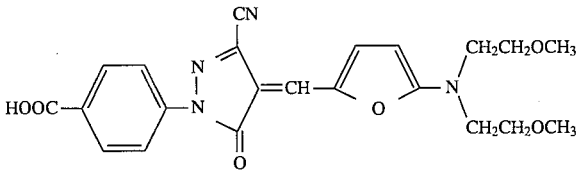

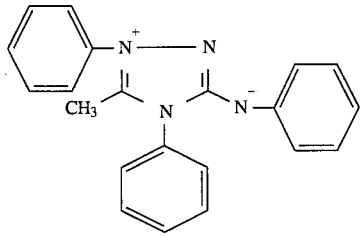
Compound (G)

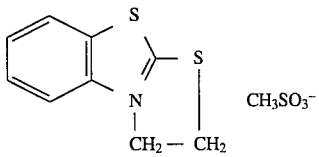
Compound (H)

-continued

Compound (I)

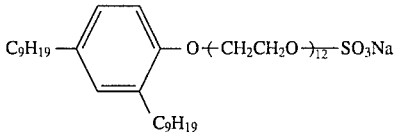

Compound (J)

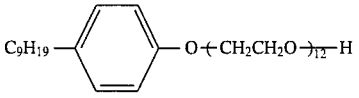

Compound (K)

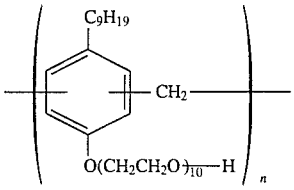

(a mixture of n = 2–5)

$C_{11}H_{23}CONH(CH_2CH_2O)_5H$ Compound (O)

$C_9F_{19}O(CH_2CH_2O)_{11}H$ Compound (F-1)

$C_8F_{17}SO_2N(CH_2CH_2O)_{15}H$ Compound (F-2)
|
$C_3H_7$ $C_8F_{17}SO_2N(CH_2CH_2O)_4(CH_2)_4SO_3Na$ Compound (F-3)
|
$C_3H_7$ Compound (M)

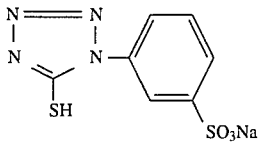

Compound (N)

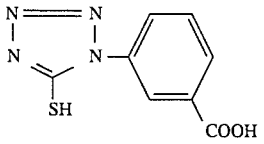

Compound (P)

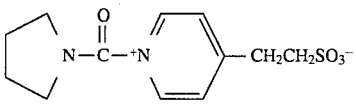

1) Evaluation of Sensitivity

Samples, after aged at 23° C. and 55% R.H. for three days, were each sandwiched with intensifying screens for X-ray photography use, KO-250 (Product of Konica), exposed to X-ray through Penetrometer type B and processed with a developer and fixer having the following compositions under the conditions as below using a roller-transport type automatic processor SRX-501 (product of Konica). Swell ratio during processing of each sample was within a range of 180 to 220%.

Processing condition:

| Step | Temp. | Time |
|---|---|---|
| Developing | 35° C. | 14.0 sec. |
| Fixing | 34° C. | 9.7 sec |
| Washing | 26° C. | 9.0 sec. |
| Squeezing | | 2.4 sec. |
| Drying | 55° C. | 8.3 sec. |
| Total | (dry to dry) | 43.4 sec. |

Composition of developer:

| | |
|---|---|
| Part A (to make 12 l) | |
| Potassium hydroxide | 450 g |
| Potassium sulfite (50% solution) | 2280 g |
| Diethylenetriaminepentaacetate | 120 g |
| Sodium hydrogen carbonate | 132 g |
| 5-Methylbenzotriazole | 1.2 g |
| 1-Phenyl-5-mercaptotetrazole | 0.2 g |
| Hydroquinone | 340 g |
| Water to make | 5000 ml |
| Part-B (to make 12 l) | |
| Glacial acetic acid | 170 g |
| Triethylene glycol | 185 g |
| 1-Phenyl-3-pyrazolidone | 22 g |
| 5-Nitroindazole | 0.4 g |
| Starter | |
| Glacial acetic acid | 120 g |
| Potassium bromide | 225 g |
| Water to make | 1.0 l |
| Composition of Fixer: | |
| Part-A (to make 18 l) | |
| Ammonium thiosulfate (70 wt./vol. %) | 6000 g |
| Sodium sulfite | 110 g |
| Sodium acetate trihydride | 450 g |
| Sodium citrate | 50 g |
| Gluconic acid | 70 g |
| 1-(N,N-dimethylamino)-ethyl-5-mercaptotetrazole | 18 g |
| Part-B (to make 18 l) | |
| Aluminum sulfate | 800 g |

To prepare the developer, Parts A and B were simultaneously added to 5 liters of water and with stirring, was further added water to make 12 liters in total, followed by adjusting a pH thereof to 10.40 with acetic acid. The resulting solution was made a developer replenishing solution. To this replenishing solution was added the starter as above-described of 20 ml per 1 liter, followed by adjusting a pH to 10.26 to make a working solution.

To about 5 liter of water were added simultaneously Part A and B with stirring and water was further added to make 18 liter in total, followed by adjusting a pH thereof to 4.0 with sulfuric acid and sodium hydroxide. The resulting solution was used as a fixer replenishing solution.

Sensitivity was defined as a relative value of reciprocal of exposure amount required for giving a density of fog +1.0, in which the sensitivity of sample 1 was set to 100.

2) Evaluation of Roller Mark

The sample was exposed overall in such an amount that gives a density of 1.0, and processed in the manner as above-described. In the processing were used a development transport rack and crossover rack between a developer bath and fixer bath which were fatigued. Transport rollers of each rack had uneven surface having a peak to valley distance of about 10 μm caused by fatigue.

After processed, occurrence of fine spot-like uneven density caused by pressure due to the uneven surface was observed particularly in a sample deteriorated in pressure resistance.

The level thereof was visually evaluated based on the following criteria.

5: No occurrence of spot

4: Slight occurrence of spots with no problem in practical use

3: Occurrence of a small number of spots at an allowable level of causing no occurrence of spots in normal rack.

2: Occurrence of spots at a level of causing to occur spots even in a normal rack.

1: Occurrence of a large number of spots at a level of causing to occur spots always in a normal rack.

Results thereof are shown in Table 1.

TABLE 1

| Sample No. | Emulsion | Gelatin content ($g/m^2$) | Sensitizer S | Sensitizer Se | Inorganic fine particles | Organic aggregation particles | Sensitivity | Roller mark |
|---|---|---|---|---|---|---|---|---|
| 1 (C) | Em-1 | 2.7 | 2.8 | 0 | None | Comp. a | 100 | 3 |
| 2 (C) | Em-1 | 2.7 | 2.8 | 0 | None | B-1 | 100 | 3 |
| 3 (C) | Em-1 | 2.3 | 2.8 | 0 | None | Comp. a | 120 | 2 |
| 4 (I) | Em-1 | 2.3 | 2.8 | 0 | None | B-1 | 120 | 4 |
| 5 (I) | Em-1 | 1.8 | 2.8 | 0 | None | B-1 | 140 | 4 |
| 6 (I) | Em-1 | 1.5 | 2.8 | 0 | None | B-1 | 160 | 4 |
| 7 (I) | Em-1 | 1.8 | 2.8 | 0 | None | B-11 | 140 | 4 |
| 8 (I) | Em-1 | 1.8 | 2.0 | 0.4 | None | B-1 | 180 | 5 |
| 9 (I) | Em-1 | 1.8 | 2.8 | 0 | A-1 | B-1 | 150 | 5 |
| 10 (I) | Em-1 | 1.8 | 2.8 | 0 | A-2 | B-1 | 160 | 5 |
| 11 (I) | Em-1 | 1.8 | 2.8 | 0 | A-3 | B-1 | 160 | 5 |
| 12 (I) | Em-1 | 1.8 | 2.8 | 0 | MA-1 | B-1 | 155 | 5 |
| 13 (I) | Em-1 | 1.8 | 2.8 | 0 | MA-2 | B-1 | 160 | 5 |
| 14 (I) | Em-1 | 1.8 | 2.8 | 0 | MA-7 | B-1 | 160 | 5 |
| 15 (I) | Em-1 | 1.8 | 2.0 | 0.4 | A-1 | B-1 | 190 | 5 |
| 16 (I) | Em-1 | 1.8 | 2.0 | 0.4 | A-2 | B-1 | 200 | 5 |
| 17 (I) | Em-1 | 1.8 | 2.0 | 0.4 | MA-1 | B-1 | 195 | 5 |
| 18 (I) | Em-1 | 1.8 | 2.0 | 0.4 | MA-2 | B-1 | 200 | 5 |
| 19 (C) | Em-2 | 2.7 | 2.8 | 0 | None | B-1 | 80 | 1 |
| 20 (I) | Em-2 | 2.3 | 2.8 | 0 | None | B-1 | 100 | 4 |
| 21 (I) | Em-2 | 1.8 | 2.8 | 0 | None | B-1 | 110 | 4 |
| 22 (I) | Em-2 | 1.5 | 2.8 | 0 | None | B-1 | 120 | 4 |
| 23 (I) | Em-2 | 1.8 | 2.8 | 0 | A-1 | B-1 | 120 | 5 |
| 24 (I) | Em-2 | 1.8 | 2.8 | 0 | A-2 | B-1 | 130 | 5 |
| 25 (I) | Em-2 | 1.8 | 2.8 | 0 | MA-1 | B-1 | 125 | 5 |
| 26 (I) | Em-2 | 1.8 | 2.8 | 0 | MA-2 | B-1 | 130 | 5 |

C: Comparison

I: Invention

S: Sodium thiosulfate (mg/mol Ag)

Se: Triphenylphosphine selenide (mg/mol Ag)

Comp.a: Polymethyl methacrylate particles having an average size of 4.0 μm

As can be seen from the table, it is proved that inventive samples were high in sensitivity and excellent in pressure resistance without occurrence of roller marks (spot).

Example 2

Samples Nos. 1 to 18 were exposed to X-ray and processed with the same developer and fixer as in Example 1 using a modified SRX-501 type processor at a higher transporting speed. Running processing was continued under the following processing condition 1 or 2 until a steady state was reached to prepare running-equilibrium solutions 1 and 2.

Ultra-Rapid Processing (B)

| | Temp. | Time |
|---|---|---|
| Developing | 38° C. | 7.0 sec. |
| Fixing | 37° C. | 4.0 sec. |
| Washing | 26° C. | 7.0 |
| Squeezing | | 2.4 sec. |
| Drying | 58° C. | 4.0 sec. |
| Total | (Dry to dry) | 24.4 sec. |

Replenishing rates were varied as below:

| | (Condition 1) | (Condition 2) |
|---|---|---|
| Developer-replenishing rate | 14.0 ml* (180 $ml/m^2$) | 7.0 ml* (90 $ml/m^2$) |
| Fixer-replenishing rate | 14.0 ml* (180 $ml/m^2$) | 7.0 ml* (90 $ml/m^2$) |

(*: per sheet having a size of 10 × 12 inches)

Samples Nos. 1 to 13 were processed with the above running equilibrium solution 1 (Condition 1) or 2 (condition 2)under the ultra-rapid processing condition B, and evaluated with respect to sensitivity and roller marks.

TABLE 2

| Sample No. | Sensitivity Condition 1 | Sensitivity Condition 2 | Roller mark Condition 1 | Roller mark Condition 2 |
|---|---|---|---|---|
| 1 | 100 | 50 | 1 | 1 |
| 2 | 100 | 60 | 1 | 1 |
| 3 | 120 | 60 | 1 | 1 |
| 4 | 120 | 100 | 4 | 4 |
| 5 | 140 | 120 | 4 | 4 |
| 6 | 160 | 140 | 4 | 4 |
| 7 | 140 | 120 | 4 | 4 |
| 8 | 180 | 170 | 5 | 5 |
| 9 | 150 | 130 | 5 | 5 |
| 10 | 160 | 145 | 5 | 5 |
| 11 | 160 | 145 | 5 | 5 |
| 12 | 160 | 150 | 5 | 5 |
| 13 | 160 | 150 | 5 | 5 |
| 14 | 160 | 150 | 5 | 5 |

TABLE 2-continued

| Sample No. | Sensitivity | | Roller mark | |
|---|---|---|---|---|
| | Condition 1 | Condition 2 | Condition 1 | Condition 2 |
| 15 | 190 | 180 | 5 | 5 |
| 16 | 200 | 195 | 5 | 5 |
| 17 | 195 | 185 | 5 | 5 |
| 18 | 195 | 185 | 5 | 5 |

As can be seen from Table 2, inventive samples were shown to be litttle lowering in sensitivity and excellent in pressure resistance without occurrence of roller mark, as compared to comparative samples.

What is claimed is:

1. A silver halide photographic element comprising a support having, on at least one side thereof, a light-sensitive silver halide emulsion layer and a nonlight-sensitive hydrophilic colloidal layer, wherein said nonlight-sensitive layer contains organic material-aggregation particles; and gelatin contained in the total hydrophilic colloidal layers provided on one side of the support amounts to a range of 1.3 to 2.5 g per $m^2$ of a photographic element.

2. The photographic element of claim 1, wherein said aggregation particles have an average size of 1.0 to 20.0 μm and are comprised of fine particles in an aggregated form; said fine particles having an average size of 0.05 to 0.50 μm and comprising polyalkyl methacrylate, polyalkyl acrylate or polystyrene.

3. The photographic element of claim 2, wherein said aggregation particles are contained in an amount of 10 to 200 mg per $m^2$ of the photographic element.

4. The photographic element of claim 1, wherein said silver halide emulsion layer contains tabular grains having an average aspect ratio of grain diameter to thickness of 2 or more and accounting for 50% or more of the total projected area of grains contained in the emulsion layer.

5. The photographic element of claim 4, wherein said tabular grains are selenium-sensitized.

6. The photographic element of claim 4, wherein said tabular grains comprise silver iodobromide or silver iodochlorobromide.

7. The photographic element of claim 1, wherein said silver halide emulsion layer further contains inorganic fine grains having an average grain size of 1 to 300 nm and comprising a silicon oxide, aluminium oxide, antimony oxide, titanium oxide, zinc oxide, niobium oxide, zirconium oxide, tin oxide, vanadium oxide or yttrium oxide.

8. The photographic element of claim 7, wherein said inorganic fine grains comprise silicon oxide, antimony oxide or yttrium oxide.

9. The silver halide photographic element of claim 7, wherein said inorganic fine grains are each covered with a gelatin shell.

10. A method of processing the photographic element as claimed in claim 1 with an automatic processor, comprising developing the exposed photographic element in a developer, fixing the element in a fixer, washing and drying, wherein said developer is replenished by a developer-replenishing solution at a rate of 35 to 94 ml/$m^2$ of the element, said photographic element being processed over a period of time of 10 to 30 seconds in total.

* * * * *